US007407382B2

(12) United States Patent
Schoell

(10) Patent No.: US 7,407,382 B2
(45) Date of Patent: Aug. 5, 2008

(54) STEAM GENERATOR IN A HEAT REGENERATIVE ENGINE

(75) Inventor: Harry Schoell, Pompano Beach, FL (US)

(73) Assignee: Cyclone Power Technologies, Inc., Pompano Beach, FL (US)

( * ) Notice: Subject to any disclaimer, the term of this patent is extended or adjusted under 35 U.S.C. 154(b) by 293 days.

(21) Appl. No.: 11/416,039

(22) Filed: May 2, 2006

(65) Prior Publication Data

US 2007/0056286 A1 Mar. 15, 2007

Related U.S. Application Data

(62) Division of application No. 11/225,422, filed on Sep. 13, 2005, now Pat. No. 7,080,512.

(51) Int. Cl.
*F27D 17/00* (2006.01)

(52) U.S. Cl. ..... 432/180; 432/181; 122/247; 60/670

(58) Field of Classification Search ..... 432/180, 432/181; 122/1 A, 36, 247; 165/8–10, 159, 165/163; 60/670; 123/25 P, 250–252
See application file for complete search history.

(56) References Cited

U.S. PATENT DOCUMENTS 1,288,055 A * 12/1918 Langsekamp ..... 165/162
4,611,655 A * 9/1986 Molignoni ..... 165/163
5,687,678 A * 11/1997 Suchomel et al. ..... 122/250 R
6,237,545 B1 * 5/2001 Barnett et al. ..... 122/235.23
7,080,512 B2 * 7/2006 Schoell ..... 60/670

* cited by examiner

*Primary Examiner*—Gregory A Wilson
(74) *Attorney, Agent, or Firm*—Robert M. Downey, PA

(57) ABSTRACT

A steam generator in a heat regenerative engine includes a cylindrical combustion chamber that encloses a circularly wound coil of densely bundled tubes. The tube bundle is heated by two combustion nozzle assemblies, each having an air blower, a fuel atomizer, and an igniter. The igniter burns atomized fuel that exits the atomizer and is mixed with pre-heated air. The flames and heat from the combustion nozzle assemblies are directed in a centrifuge within the circular combustion chamber. This cyclonic circulation of combustion gases within the combustion chamber creates higher efficiency in the engine by subjecting the coil of tubes to multiple passes of heat, thereby promoting greater heat saturation relative to the amount of fuel expended. The relatively small diameter and large surface area of the tubes in the bundle allows the water and steam in the tubes to be heated to higher temperatures and pressures within a compact space, providing a highly efficient steam generator.

5 Claims, 2 Drawing Sheets

STEAM GENERATOR IN A HEAT REGENERATIVE ENGINE

This application is divisional patent application of patent application Ser. No. 11/225,422 filed on Sep. 13, 2005, now U.S. Pat. No. 7,080,512 the full disclosure of which is incorporated herein by reference.

BACKGROUND OF THE INVENTION

1. Field of the Invention

This invention relates to steam generators and, more particularly, to a steam generator that directs water through a tube bundle within a combustion chamber, and wherein the tube bundle is exposed to a cyclonic circulation of hot combustion gases.

2. Discussion of the Related Art

Environmental concerns have prompted costly, complex technological proposals in engine design. For instance, fuel cell technology provides the benefit of running on clean burning hydrogen. However, the expense and size of fuel cell engines, as well as the cost of creating, storing, and delivering fuel grade hydrogen disproportionately offsets the environmental benefits. As a further example, clean running electric vehicles are limited to very short ranges, and must be regularly recharged by electricity generated from coal, diesel or nuclear fueled power plants. And, while gas turbines are clean, they operate at constant speed. In small sizes, gas turbines are costly to build, run and overhaul. Diesel and gas internal combustion engines are efficient, lightweight and relatively inexpensive to manufacture, but they produce a significant level of pollutants that are hazardous to the environment and the health of the general population and are fuel specific.

The original Rankin Cycle Steam Engine was invented by James Watt over 150 years ago. Present day Rankin Cycle Steam Engines use tubes to carry super heated steam to the engine and, thereafter, to a condenser. The single tubes used to pipe super heated steam to the engine have a relatively large interior volume which limits pressure and temperature levels. The less desirable lower pressures and temperatures, at which water can easily change state between liquid and gas, requires a complicated control system. While Steam Engines are generally bulky and inefficient, they tend to be environmentally clean. Steam Engines have varied efficiency levels ranging from 5% on older model steam trains to as much as 45% in modern power plants. In contrast, two-stroke internal combustion engines operate at approximately 17% efficiency, while four-stroke internal combustion engines provide efficiency up to approximately 25%. Diesel combustion engines, on the other hand, provide as much as 35% engine efficiency.

SUMMARY OF THE INVENTION

The combustion chamber of the present invention is arranged in the form of a cylinder which encloses a circularly wound coil of densely bundle tubes. The tubes are heated by two combustion nozzle assemblies, each comprising an air blower, a fuel atomizer, and an igniter. These combusters are mounted on opposed sides of the circular combustion chamber wall and are aligned to direct their flames in a circular direction. This cyclonic circulation of combustion gases within the combustion chamber creates higher efficiency in the engine by subjecting the coil of tubes to multiple passes of hot gas, thereby promoting greater heat saturation relative to the amount of fuel expended.

The multi-tube coil within the combustion chamber further contributes to the efficiency of the steam generator. The shape of the circularly wound bundle of tubes permits greater lengths of tube to be enclosed within the compact combustion chamber. Furthermore, by splitting each water supply line into two smaller lines where it enters the combustion chamber, a greater tube surface area is exposed to the combustion gases, promoting greater heat transfer. As a result, the smaller volume of water within the smaller lines is more quickly heated. Also, because the smaller tubes are stronger than a single large diameter tube, the steam in the smaller tubes can be heated to higher temperatures and pressures. This further improves the efficiency of the steam generator, as well as the engine.

OBJECTS AND ADVANTAGES OF THE INVENTION

It is a primary object of the present invention to provide a combustion chamber for a heat regenerative engine that efficiently generates super heated steam within a compact combustion chamber, while burning fuel efficiently and with low emissions of pollutants.

It is a further object of the present invention to provide a steam generator that includes a combustion chamber adapted to produce a cyclonic circulation of combustion gases that causes heavier, unburned particles to be incinerated, thereby contributing to a cleaner exhaust.

It is a further object of the present invention to provide a steam generator that comprises a combustion chamber that surrounds a multi-tube coil, and wherein the combustion chamber is provided with combustion nozzle assemblies adapted to produce a cyclonic circulation of flames and combustion gases within the combustion chamber to subject the multi-tube coil to multiple passes of hot gases, thereby promoting more efficient heat saturation and steam generation.

It is still a further object of the present invention to provide a steam generator that includes a combustion chamber surrounding a multi-tube coil, and wherein the multi-tube coil provides for small tubes within a wound bundle for more efficient heat transfer and generation of steam.

It is still a further object of the present invention to provide a steam generator comprising a circular combustion chamber surrounding a multi-tube coil of steam lines, and wherein the combustion chamber and multi-tube coil are adapted to heat steam within the multi-tube coil to higher temperatures and pressures, thereby increasing the efficiency of steam generation.

These and other objects advantages are more readily apparent with reference to the detailed description and drawings.

BRIEF DESCRIPTION OF THE INVENTION

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Figure 1:
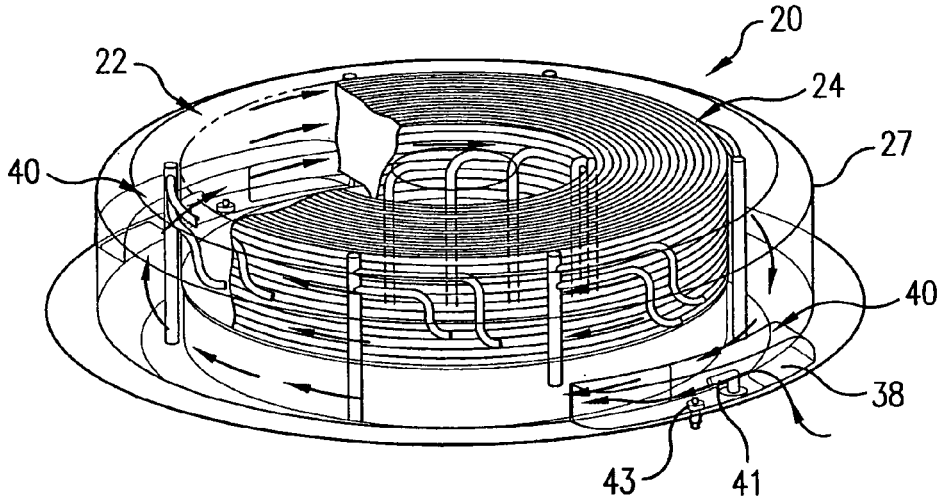
FIG. 1 is a perspective view of the steam generator of the present invention, shown in partial cut-away, with a multi-tube coil surrounded by a combustion chamber.
Figure 2:
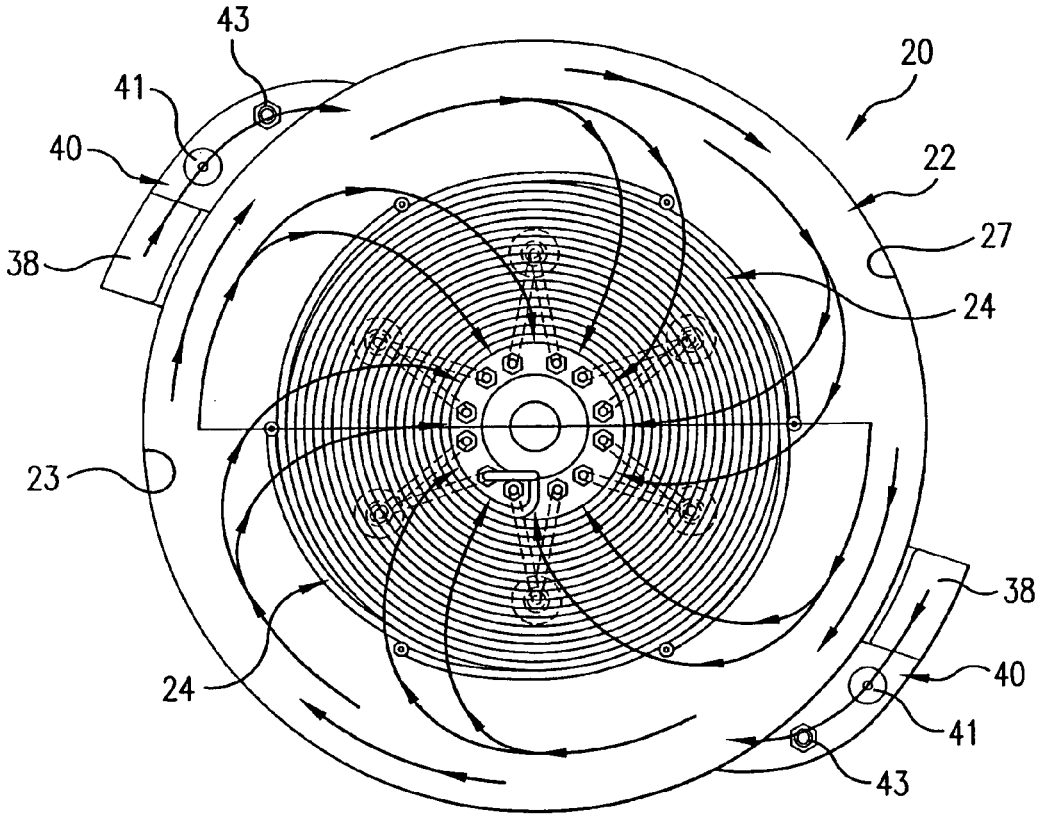
FIG. 2 is a top plan view taken from within the combustion chamber illustrating a cyclonic circulation of combustion gases relative to the multi-tube coil.
Figure 3:
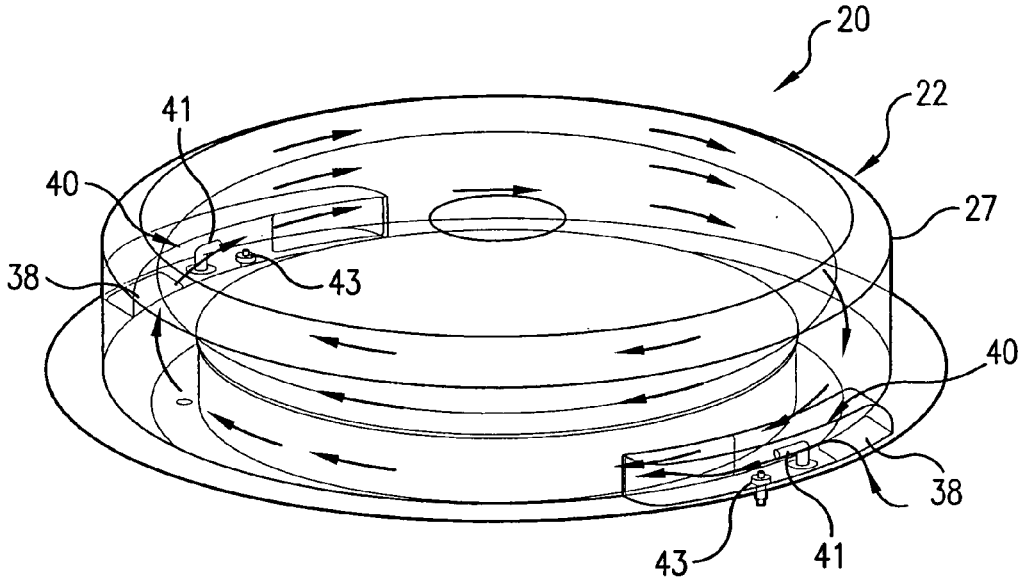
FIG. 3 is a perspective view, in general outline form, showing the combustion chamber.
Figure 4:
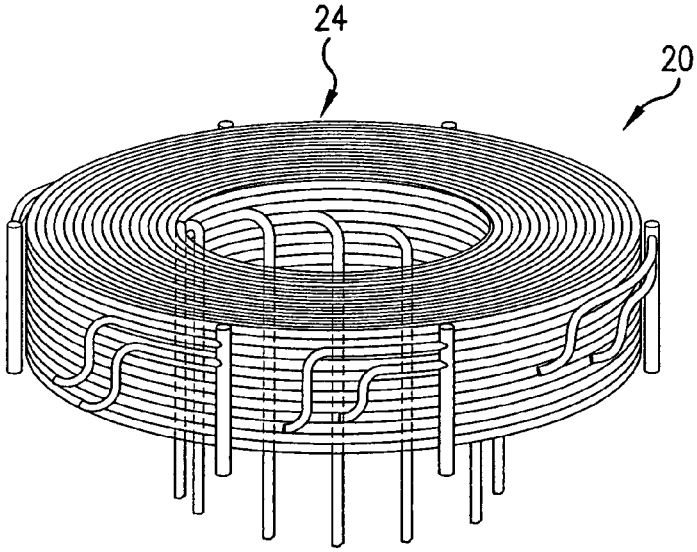
FIG. 4 is a perspective view of the multi-tube coil of the steam generator.

The steam generator is shown throughout the several views of the drawings and is generally indicated as 20. The steam generator 20 is generally comprised of a combustion chamber 22 and a bundle of tubes 24. The combustion chamber 22 is arranged in the form of a cylinder which encloses the circularly wound coil of densely bundled tubes 24 forming a portion of steam supply lines in an engine. The bundled tubes 24 are heated by the burning fuel with a combustion nozzle burner assembly 40. In a preferred embodiment, there are two burner assemblies. Each combustion nozzle burner assembly 40 includes an air blower 38, a fuel atomizer 41, and an igniter 43. The burner assemblies 40 are mounted on opposite sides of the circular combustion chamber wall and are aligned to direct their flames in a spiral direction. By spinning the flame front around the combustion chamber, the coil of tubes 24 is repetitively 'washed' by the heat of this combustion gas which circulates in a motion to the center of the tube bundle 24. The tube bundle 24 carries the steam and is exposed to the high temperatures of combustion, where the steam is superheated and maintained at a desired high pressure. The hot gas exits through an aperture located at the top center of the round roof of the cylindrical combustion chamber. The centrifugal motion of the combustion gases, as depicted by the directional arrows in FIGS. 1-3, causes the heavier, unburned particles suspended in the gases to accumulate on the outer wall 27 of the combustion chamber 22 where they are incinerated. This results in a cleaner exhaust with lower emissions of pollutants. This cyclonic circulation of combustion gases within the combustion chamber creates higher efficiency in steam generation. Specifically, multiple passes of the coil of tubes 24 allows for promoting greater heat saturation relative to the amount of fuel expended. Moreover, the arrangement of the circularly wound bundle of tubes permits greater lengths of tube to be enclosed within a compact combustion chamber. Furthermore, by dividing each steam supply line into two or more lines at entry to the combustion chamber (i.e. in the tube bundle), a greater tube surface area is exposed to the combustion gases, promoting greater heat transfer so that the fluid can be heated to higher temperatures and pressures which further improves the efficiency of the engine.

While the present invention has been shown and described in accordance with a preferred and practical embodiment thereof, it is recognized that departures from the instant disclosure are contemplated within the spirit and scope of the present invention.

What is claimed is:

1. A steam generator for an engine, said steam generator comprising:

a combustion chamber surrounded by a cylindrical outer wall and top wall and including at least one combustion nozzle assembly for producing a cyclonic circulation of hot combustion gases;

a multi-tube coil including a plurality of individual tubes wound in a bundle and each of said plurality of tubes being structured and disposed for passage of water and steam therethrough; and said multi-tube coil being exposed to said cyclonic circulation of hot combustion gases within said combustion chamber to heat said plurality of individual tubes to a temperature that transforms the water in the tubes into steam, and said cyclonic circulation of hot combustion gases further heating the tubes to a temperature that increases the pressure and temperature of the steam within said plurality of tubes.

2. The steam generator as recited in claim 1 wherein said at least one combustion nozzle assembly comprises:

an air blower for producing a flow of air directed into said combustion chamber and into said cyclonic circulation of hot combustion gases;

a fuel atomizer for producing an atomized mist of fuel; and an igniter for igniting the atomized mist of fuel within said air flow to produce said cyclonic circulation of hot combustion gases.

3. The steam generator as recited in claim 1 wherein said multi-tube coil is surrounded by said combustion chamber and said cyclonic circulation of hot combustion gases.

4. The steam generator as recited in claim 1 further comprising:

a plurality of said combustion nozzle assemblies arranged about said combustion chamber.

5. The steam generator as recited in claim 4 wherein each of said plurality of combustion nozzle assemblies comprises:

an air blower for producing a flow of air directed into said combustion chamber and into said cyclonic circulation of hot combustion gases;

a fuel atomizer for producing an atomized mist of fuel; and an igniter for igniting the atomized mist of fuel within said air flow to produce said cyclonic circulation of hot combustion gases.

* * * * *